United States Patent [19]

Hagens et al.

[11] Patent Number: 5,039,023

[45] Date of Patent: Aug. 13, 1991

[54] PROCESS AND APPARATUS FOR WINDING A FILM WEB

[75] Inventors: Hajo Hagens, Wiesbaden-Auringen; Reinhard Kober, Eltville; Wolfgang Oberhausen, Mainz-Ebersheim; Thomas Heusel; Stefan Sinzig, both of Wiesbaden, all of Fed. Rep. of Germany

[73] Assignee: Hoechst Aktiengesellschaft, Frankfurt am Main, Fed. Rep. of Germany

[21] Appl. No.: 503,016

[22] Filed: Apr. 2, 1990

[30] Foreign Application Priority Data

Apr. 21, 1989 [DE] Fed. Rep. of Germany ..... 3913131

[51] Int. Cl.[5] ..... B65H 18/10; B65H 18/16

[52] U.S. Cl. ..... 242/67.1 R; 242/65

[58] Field of Search ..... 242/67.1 R, 67.2, 75.1, 242/65, 66, 75.2

[56] References Cited

U.S. PATENT DOCUMENTS 4,576,344 3/1986 Sasaki et al. ..... 242/67.1 R 4,830,303 5/1989 Hagens et al. ..... 242/67.1 R

*Primary Examiner*—John M. Jillions

*Attorney, Agent, or Firm*—Gregory N. Clements

[57] ABSTRACT

In an interstice 6 between a film reel 8 and a contact roll 3, two air displacement rollers 5*a*, 5*b* are arranged parallel to the film reel 8 and the contact roll 3. In comparison with the contact roll and the winding core 2, these two air displacement rollers have a smaller diameter of about 7.5 to 50 mm. The rollers squeeze out the air boundary layers 4 at the film web layers 1 moving into the interstice 6. The contact roll 3 and one of the air displacement rollers 5*a* have a smooth hard surface layer with an average peak-to-valley height Ra of less than 0.4 microns and a Brinell hardness HB of greater than 10 HB 2.5/62.5. The distance between the two air displacement rollers and the contact point of film reel with the contact roll is chosen so small that new air boundary layers on the film web sections within the interstice can form only to a slight extent.

21 Claims, 2 Drawing Sheets

Fig. 4.
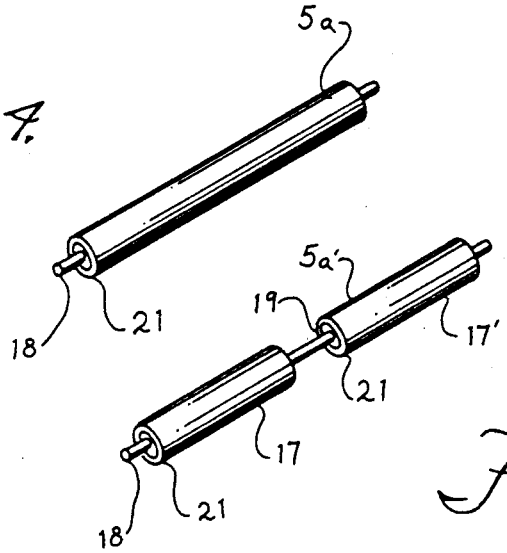
Fig. 3.
Fig. 2.
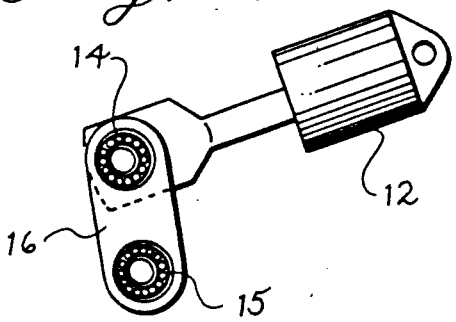
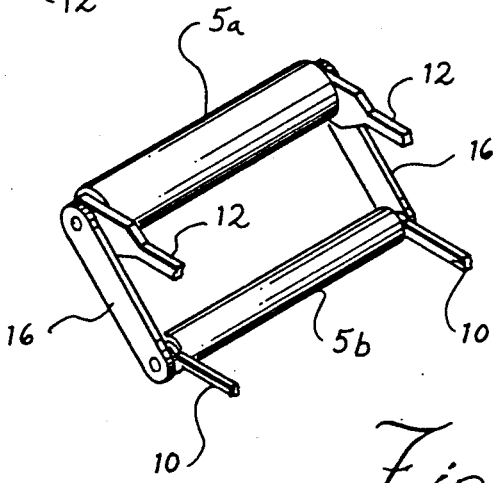
Fig. 5.

PROCESS AND APPARATUS FOR WINDING A FILM WEB

BACKGROUND OF THE INVENTION

1) Field Of The Invention

The present invention relates to a process for winding-up a film web onto a winding core to form a film reel, having a contact roll, via which the film web is fed to the film reel. The film reel and the contact roll rotate in opposite directions but at the same circumferential speed. Air boundary layers on the circumferential surface of the film reel and air boundary layers at the film web running over the contact roll are squeezed out before bringing together the two film webs. The present invention also relates to an apparatus for winding a film web.

2) Prior Art

Such a process and an apparatus for winding a film web are known from German Offenlegungsschrift 37 10 412 and operate, for example, satisfactorily for winding speeds up to about 100 m/min in the case of very thin film webs, for example 3 microns PET films.

In the production of films, the winding of the film web as the last process step has a considerable importance, since, in so doing, the film web meeting the specification may be wound "wrongly" to such an extent that a total loss of the film reel can occur due to damages to the film web, particularly during storage.

A particularly important problem in this context is represented by the phenomenon that considerable quantities of air can be enveloped in the film reel during winding. Some of this enveloped air escapes during the storing of the film reel and various defects, such as marks, stretches and cross waves, can occur in and on the film reel, which may cause the film reel to be completely unusable.

In the case of a known apparatus for winding sheet-like structures, the film web running onto the reel is pressed against the reel with the aid of a so-called contact roll, achieving the result that lesser quantities of air are enveloped during winding than without this measure. This apparatus is described in German Patent 32 65 570 (equivalent to U.S. Pat. No. 4,576,344). However, the air-displacing effect of the contact roll decreases with increasing winding speed, so that a compromise must be made between the winding speed and the enveloping of air. The entire phenomenology of air envelopment, with special consideration of the dependence of air envelopment on contact roll pressure against the reel, is the subject of research and development.

It has also been proposed to carry out the entire winding operation in a vacuum in order to solve the problem of air envelopment in this way, but the great financial expenditure is a factor against a realization of this proposal.

The object of the invention is to improve the process described at the beginning and to develop an apparatus for winding-up a film web in such a way that the winding speed can be increased substantially and that wind-up application for ultra-thin films with a thickness down to about 1 micron is possible.

SUMMARY OF THE INVENTION

This object is achieved according to the present invention by the fact that the coated contact roll has an average peak-to-valley height Ra of the surface of less than 0.4 microns and a Brinell hardness of greater than 10 HB 2.5/62.5.

In implementation of the process, the average peak-to-valley height Ra is chosen in the range of 0.001 microns $<$ Ra $<$ 0.4 microns and, in particular Ra is equal to about 0.03 microns. The thinner the film webs, the smaller the average peak-to-valley height Ra is required.

In the broadest sense, the process of the present invention comprises feeding the film web to a contact roll, winding the film web upon a winding core to form a film reel, wherein said contact roll is in contact with said film reel, contacting the film web layer on the contact roll and the film web layer on the periphery of the film reel with a pair of rollers, squeezing out the air boundary layers around the film web layers on the contact roll and the film web layer on the film reel, wherein the coated contact roll has an average peak-to-valley height Ra of the surface of less than 0.4 microns and a Brinell hardness of greater than 10 HB 2.5/62.5.

The apparatus for winding-up a film web onto a winding core to form a film reel, using a contact roll where the contact roll and the film reel run at the same circumferential speed in opposite directions to each other, includes having two rollers arranged axially parallel to the winding core and to the contact roll in a film interstice. The two rollers are in pressure contact with the film web on the film reel and additionally one of the two rollers is in pressure contact with the film web on the contact roll. The contact roll has a smooth hard surface with an average peak-to-valley height Ra of less than 0.4 microns and a Brinell hardness of greater than 10 HB 2.5/62.5.

The advantage is achieved by the present invention in that the two rollers for squeezing-out the air boundary layers interact with the hard smooth surface of the contact roll of defined hardness and given average peak-to-valley height so effectively that ultra-thin films can be wound up with substantially increased winding speed in comparison with the previous process, without losses in the hardness of the reel or quality losses, for example in the freedom from folds of the reel.

BRIEF DESCRIPTION OF THE DRAWINGS

The invention is explained in more detail below with reference to an exemplary embodiment represented by the drawing, in which:

FIG. 2 shows an enlarged detailed side view of the air displacement rollers and the control cylinder as shown in FIG. 1;

FIGS. 3 and 4 show two embodiments of rollers for air displacement for film webs;

FIG. 5 shows a further embodiment of two rollers for air displacement for film webs, each of the rollers having a diameter of different size.

DESCRIPTION OF THE PREFERRED EMBODIMENTS

Figure 1:
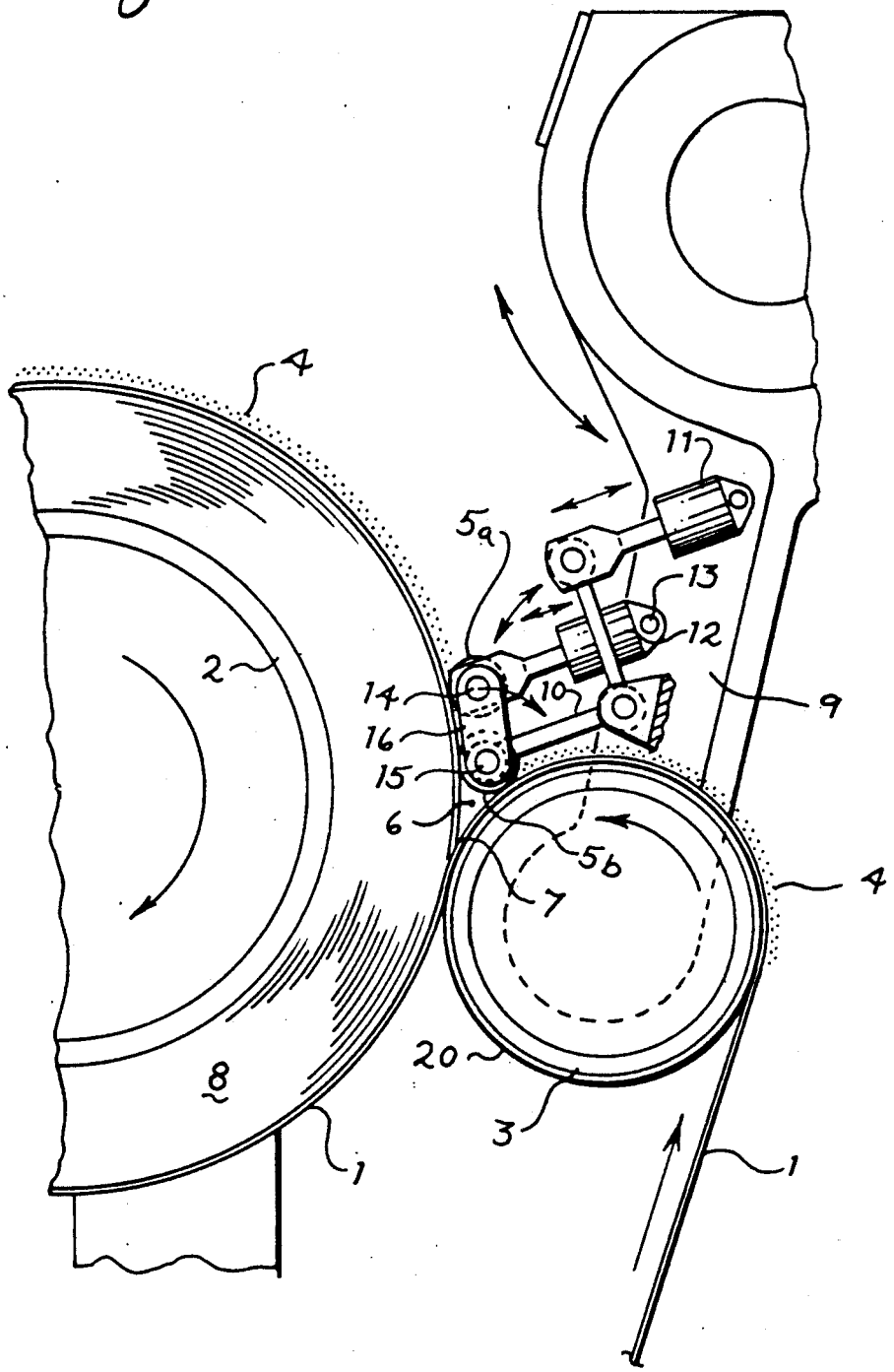
FIG. 1 shows a cross sectional side view of the apparatus according to the present invention.

For winding-up onto a winding core 2, a film web 1 is passed over a contact roll 3, which bears against a film reel 8. The film reel and the contact roll run at the same circumferential speed in opposite directions to each other. Both on the film web 1 fed via the contact roll, and on the outer turn of the film web 1 on the film reel 8 there are air boundary layers, which are squeezed out before the two film web layers are brought together. The squeezing-out of the air boundary layers over the entire film web width is performed by mechanical pressure. The distance between the point of contact or bringing together of two film web layers and the squeezing-out points on the film webs, i.e., the depths of the interstice which is bounded by the film reel and the contact roll, is kept as small as possible and is 13 to 200 mm.

In the apparatus according to FIG. 1, a film web 1 is passed over a contact roll 3, and at a contact point 7 runs onto a winding core 2 forming a film reel 8. During winding, considerable quantities of air are generated and enveloped in a tapering interstice 6 between the film reel 8 and the contact roll 3 which can be explained by the fact that air boundary layers 4, drawn shaded in FIG. 1, adhere to each of the film web layers 1 due to friction and are transported by them in the direction of the contact point 7. These friction-induced air boundary layers 4 exist both on the outside of the film web 1, which is passed over the contact roll 3, and on the circumferential surface or the outer turn of the film web 1 on the film reel 8.

The contact roll 3 has a hard, smooth surface layer 20, which has an average peak-to-valley height Ra of less than 0.4 microns and a Brinell hardness of greater than 10 HB 2.5/62.5. The Brinell hardness HB is determined in accordance with the Brinell hardness test, as specified in DIN standard 50351. Thus, the combination of numbers 2.5/62.5 means that the hardness measurement is carried out with a ball 2.5 mm in diameter, which is pressed with a test force of 62.5 kp (about 613 N) against the surface layer 20.

The average roughness is smaller when thinner film webs are to be wound. The average peak-to-valley height (Ra) is generally in the range of 0.001 microns $<Ra<$ 0.4 microns, and preferably Ra is about 0.03 microns, measured in accordance with DIN 7162.

The apparatus described makes winding of ultra-thin films possible, such as for example PET films of 2 microns thickness, at speeds up to about 220 m/min.

The surface layer 20 of the contact roll 3 can be applied electrolytically or chemically by hard chromium plating. The inner structure of the roll body of the contact roll 3 can be freely selected, as long as the above conditions for Brinell hardness and roughness are met. A typical example of such a contact roll is a roll with a hard chromium-plated surface layer 20. Other common surface layers applied by electrolytic or chemical means are aluminum, Al-Mg and/or Al-Cu alloys.

The surface layer 20 of the contact roll 3 may also be applied by thermal spraying, for example plasma spraying of oxides or carbides, such as silicon oxide, chromium oxide or silicon carbide.

With the aid of two air displacement rollers 5*a* and 5*b*, arranged axially parallel to the film reel 8 and to the contact roll 3, the air boundary layers 4 are squeezed out from the film web layers or greatly reduced before their entry into the interstice 6. The air displacement rollers 5*a* and 5*b* have diameters of 7.5 to 50 mm and extend over the entire film web width. The distance between the contact point 7 and the rollers 5*a* and 5*b* should be as small as possible in order to avoid or minimize as much as possible the new formation of air boundary layers in the interstice 6. Preferably, the distance is from 1–6 times the diameter of one of the rollers 5*a* or 5*b*. Consequently, the diameters of the rollers 5*a* and 5*b* are chosen small in comparison with the diameter of the contact roll 3 and of the winding core 2, or of the film reel 8. The diameters of the rollers 5*a* and 5*b* are generally of the same size, but it may also be possible for them to be of different sizes (see FIG. 5). The roller diameters correspond to 0.1 to 0.5 times, in particular 0.15 to 0.3 times, the contact roll diameter and 0.05 to 0.3 times, in particular 0.1 to 0.2 times, the winding core diameter.

The roller 5*a*, which is in contact with the film web 1 on the film reel 8, has a smooth hard surface layer 21, as is shown in FIG. 4. The same conditions for Brinell hardness and roughness, i.e., the average peak-to-valley height Ra, apply to this surface layer 21 as to the surface layer 20 of the contact roll 3. Similarly, the material of the surface layer 21 and the method of application of the surface layer on the roller body of the roller 5*a* coincide with the material and the method of application of the surface layer 20 on the contact roll 3. Due to the small diameter of the roller 5*a*, in comparison with the contact roll 3, it may also be produced from solid material and the surface then worked correspondingly in order to meet the conditions given above for hardness and average roughness.

The roller 5*b*, which is in contact with the film web 1 on the contact roll 3, has a hard/flexible surface, generally a hard rubber-covered surface.

The air displacement rollers 5*a* and 5*b* can only eliminate the air boundary layers with lasting effect if they are pressed with strong pressure against the film reel 8 rolled onto the winding core 2, and against the film web 1 running over the contact roll 3. The pressure contact control apparatus parts 9 to 16, which are described below, serve this purpose.

With respect to contact roll holder 9, the roller 5*b*, bearing against the contact roll 3, is arranged in a fixed position during the entire winding operation. Each of the ends of the roller 5*b* is pressed against the contact roll 3 by a cylinder 11, via an angle lever 10 in each case. The two cylinders 11 are fastened to the contact roll holder 9.

Due to the changing reel diameter during the winding operation, the roller 5*a* bearing against the film reel 8 must be movably arranged. This is taken care of by a cylinder 12, mounted pivotably in a joint 13, as well as by a spacer 16, mounted pivotably in joints 14 and 15, which together guide the roller 5*a* and make possible its displacement with respect to the fixed roller 5*b* with increasing reel diameter.

The spacer 16 and the two joints 14 and 15, for example ball bearing joints, are represented on an enlarged scale together with the cylinder 12 in FIG. 2.

Although the contact roll 3 and the film reel 8, and consequently also the rollers 5*a* and 5*b*, have one and the same circumferential speed, there should nevertheless, for safety reasons, always be a small distance of 0.2 to 5.0 mm, in particular of 0.5 to 1 mm, between the rollers 5*a* and 5*b*, in order to avoid a blocking or shuddering in the event of contact if there are small differences in speed between the rollers 5*a* and 5*b*.

The widths of the film webs 1 may be up to 1000 mm, but wider film webs can also be wound with such an apparatus. A one-part roller 5*a*, as FIG. 4 shows, has a uniform contour or constant diameter over the entire length and is seated on a spindle 18. If, in the case of wider film webs, the mechanical stability of the rollers 5*a* and 5*b* is no longer adequate with suspension only at the roller ends, a roller 5*a*′ consisting of two or more component pieces 17, 17′ (see FIG. 3) can also be used.

These component pieces have a uniform diameter and are likewise seated on a spindle 18. The mechanical loading of the multi-part roller can be reduced by fitting further cylinders 11 and 12 on roller spacing portion 19.

In FIGS. 4 and 3, the surface layers 21 of the one-part and of the multi-part roller 5*a* and 5*a*', respectively, are represented diagrammatically. The multi-part design can similarly be used in the case of roller 5*b* having the hard/flexible or rubber surface layers as previously described instead of the surface layers 21.

The roller spacing portion 19 has a diameter smaller than the roller diameter of the component pieces 17, 17' and forms a recessed roller area between the two neighboring component pieces of the multi-part roller 5*a*'.

What is claimed is:

1. A process for winding a film web onto a winding core to form a film reel using a contact roll, comprising: feeding a film web to a contact roll whereby said film wraps around a portion of said contact roll; winding said film web upon a winding core from the contact roll, thereby forming a film reel, wherein said contact roll is in contact with said film web on said film reel forming a contact point; wherein said contact roll and said film reel run in the opposite direction to one another but at the same circumferential speed; contacting said film web on said contact roll and said film web on the periphery of said film reel with a pair of air displacement rollers; squeezing out the air boundary layers around said film web on said contact roll and on said film reel, wherein said contact roll has an average peak-to-valley height Ra of the surface of less than 0.4 microns and a Brinell hardness of greater than 10 HB 2.5/62.5.

2. The process as claimed in claim 1, wherein said average peak-to-valley height Ra is chosen in the range of 0.001 microns to 0.4 microns.

3. The process as claimed in claim 1, wherein said contact roll and one of said air displacement rollers are chromium plated, electrolytically coated, or chemically coated.

4. The process a claimed in claim 1, wherein said contact roll and at least one of said air displacement rollers is coated by thermal spraying of oxides or carbides.

5. An apparatus for winding a film web onto a winding core to form a film reel, comprising: a contact roll around which a web of film is fed; a winding core adjacent and axially parallel to said contact roll, whereby the web of film is wrapped around said winding core to form a film reel; a pair of air displacement rollers axially parallel to said winding core and said contact roll, whereby during operation said rollers are in pressure contact with the film web on said film reel and one of said pair of air displacement rollers is also in pressure contact with the film web on said contact roll, wherein said contact roll has a smooth hard surface layer which has an average peak-to-valley height Ra of less than 0.4 microns and a Brinell hardness of greater than 10 HB 2.5/62.5.

6. The apparatus as claimed in claim 5, wherein one of said air displacement rollers has a smooth hard surface layer with an average peak-to-valley height Ra of less than 0.4 microns and a Brinell hardness of greater than 10 HB 2.5/62.5.

7. The apparatus as claimed in claim 5, wherein one of said air displacement rollers in contact with the film web on said contact roll has a rubber-covered surface.

8. The apparatus as claimed in claim 6, wherein said contact roll and one of said air displacement rollers in contact with said film web on said film reel have a hard surface selected from a chromium-plated surface layer, an aluminum surface layer, an aluminum-magnesium alloy surface layer, and/or an aluminum-copper alloy surface layer.

9. The apparatus as claimed in claim 6, wherein the surface of said contact roll and one of said air displacement rollers in contact with said film reel has a surface layer selected from oxides and carbides.

10. The apparatus as claimed in claim 5, wherein the surface area of said contact roll has an average peak-to-valley height Ra in the range of 0.001 microns to 0.4 microns.

11. The apparatus as claimed in claim 6, wherein one of said air displacement rollers in contact with said film reel has a surface layer with an average peak-to-valley height Ra in the range of 0.001 microns to 0.4 microns.

12. The apparatus as claimed in claim 5, wherein said pair of air displacement rollers are substantially the same length as said contact roll and said film reel, and have a diameter in the range of 7.5 mm to 50 mm.

13. The apparatus as claimed in claim 12, wherein said pair of air displacement rollers have diameters of the same size and wherein said diameters correspond to 0.1 to 0.5 times the diameter of said contact roll and 0.05 to 0.30 times the diameter of said winding core.

14. The apparatus as claimed in claim 5, wherein said pair of air displacement rollers have different diameters.

15. The apparatus as claimed in claim 5, further including spacer means to rotatively space apart said pair of air displacement rollers positioned parallel with one another and a contact roll holder rotatively mounting said contact roll.

16. The apparatus as claimed in claim 5, wherein the distance between said contact point and said pair of air displacement rollers corresponds to 1–6 times the diameter of one of said pair of air displacement rollers.

17. The apparatus as claimed in claim 15, further including means to secure said air displacement roller in contact with said contact roll during the winding operation, said means including a pair of angle levers having first and second ends, said first ends rotatively fastened to each end of said air displacement roller in contact with said contact roll, and a pair of cylinders pivotably secured to said contact roll holder and pivotably secured at said second ends of said pair of angle levers.

18. The apparatus as claimed in claim 15, further including a pair of cylinders, said air displacement roller bearing only against said film reel connected to said pair of cylinders, said pair of cylinders pivotably mounted to said contact roll holder.

19. The apparatus as claimed in claim 15, wherein said spacer means spaces said pair of air displacement rollers from one another in the range of 0.2 to 5.0 mm.

20. The apparatus as claimed in claim 5, wherein said pair of air displacement rollers are each a one-piece roller.

21. The apparatus as claimed in claim 5, wherein at least one of said pair of air displacement rollers consists of two or more component portions, each portion having the same diameter, each portion being separated from one another by a roller spacing portion.

* * * * *